United States Patent [19]

Ze-ying

[11] Patent Number: 4,903,792

[45] Date of Patent: Feb. 27, 1990

[54] HYDRAULIC MOTORS AND VEHICLE HYDROSTATIC TRANSMISSION SYSTEM OF WHEEL MOTOR TYPE

[76] Inventor: Tan Ze-ying, 331 Central Rd., Nanjing, Jiangsu Province, China

[21] Appl. No.: 32,287

[22] Filed: Mar. 30, 1987

Related U.S. Application Data

[63] Continuation-in-part of Ser. No. 913,732, Sep. 30, 1986, Pat. No. 4,777,866.

[51] Int. Cl.[4] ..... B60K 17/10

[52] U.S. Cl. ..... 180/308; 91/488

[58] Field of Search ..... 180/308, 305, 65.5; 91/488

[56] References Cited

U.S. PATENT DOCUMENTS

| | | | |
|---|---|---|---|
| 1,906,785 | 5/1933 | Cuttat | 91/498 |
| 2,473,271 | 6/1949 | Benedak | 91/498 |
| 2,679,210 | 5/1954 | Muller | 92/58 |
| 3,131,604 | 5/1964 | Orshansky, Jr. | 91/497 |
| 3,493,067 | 2/1970 | Rumsey | 180/308 |
| 3,511,131 | 5/1970 | Kress | 91/472 |
| 3,610,384 | 10/1971 | Borck | 415/89 |
| 3,771,423 | 11/1973 | Culberson | 91/497 |
| 3,777,624 | 12/1973 | Dixon | 91/488 |
| 3,915,068 | 10/1975 | Gassman | 180/308 |
| 3,943,826 | 3/1976 | Kita | 91/488 |
| 4,099,588 | 7/1978 | Dezelan | 180/308 |
| 4,102,425 | 7/1978 | Marsden et al. | 180/308 |
| 4,362,480 | 12/1982 | Suzuki et al. | 418/178 |
| 4,478,132 | 10/1984 | Braddock | 91/498 |
| 4,503,754 | 3/1985 | Irwin | 91/498 |
| 4,503,928 | 3/1985 | Herrero et al. | 180/308 |
| 4,635,535 | 1/1987 | Thomas et al. | 91/498 |

FOREIGN PATENT DOCUMENTS

| | | | |
|---|---|---|---|
| 0078513 | 5/1983 | European Pat. Off. | 91/488 |
| 978936 | 4/1951 | France | 92/12.1 |
| 1254200 | 1/1961 | France | 91/498 |
| 2045345 | 10/1980 | United Kingdom | 91/488 |

OTHER PUBLICATIONS

Pinson, *Hydrostatic Assisting Drive,* Society of Automative Engineers Publ. No. 780756.

Nembach, *Wheel Motors for Hydrostatic Mobile Equipment,* Society of Automotive Engineers Publ. No. 810971.

Recker, *Design and Development of a Low Speed High Torque Hydraulic Motor,* Society of Automotive Engineers Publ. No. 810974.

*Primary Examiner*—David M. Mitchell

*Attorney, Agent, or Firm*—Morgan & Finnegan

[57] ABSTRACT

A vehicle with a hydrostatic transmission system of wheel motor type in which the wheel motor is specially designed to meet the strict requirements of the vehicle, with a maximum mechanical efficiency of 0.97, speed ranging from 0 to 1500 r.p.m. for both fixed displacement and continuously variable displacement, and a wide speed ratio. It is compact in size, simple in construction, and easy to produce. The system may include a manual or automatic control device of the continuously variable displacement motor or pump and a distributing valve which can control the individual working mode of each wheel motor, so that the adjustable speed range can be further extended and the mean efficiency of the vehicle can be improved.

6 Claims, 8 Drawing Sheets

HYDRAULIC MOTORS AND VEHICLE HYDROSTATIC TRANSMISSION SYSTEM OF WHEEL MOTOR TYPE

REFERENCE TO RELATED APPLICATION

This application is a continuation-in-part of U.S. patent application Ser. No. 913,732 filed Sept. 30, 1986, now U.S. Pat. No. 4, 777,866 the disclosure of which is incorporated herein by reference.

FIELD OF THE INVENTION

This invention relates to a hydrostatic transmission system and hydraulic motors and, more particularly, to a vehicle hydrostatic transmission of wheel motor type and hydraulic motors therein.

BACKGROUND OF THE INVENTION

Hydrostatic transmissions have many advantages and have found ever increasing application in recent years. However, due to the poor performance of its major components (especially the hydraulic motor or pump), its application has been very limited.

The application of hydrostatic transmissions in vehicle drive systems has numerous advantages, such as: a genuine continuously variable transmission within its full speed range; equal speeds in forward and reverse; very smooth speed change; the best matching between the engine and the transmission to improve its fuel economy and dynamic performance; easier adaptation to automatic control; and its convenient layout in the vehicle.

Hydrostatic transmissions of wheel motor type are an ideal power transmission system for most vehicles. These transmissions consist of a pump driven by an engine, the high pressure oil from the pump being delivered to hydraulic wheel motors in the wheels via control valves, hoses or pipes to generate a driving torque to propel the vehicle. Obviously, this layout could take full advantage of the merits of hydrostatic transmissions and offer many other advantages in addition to those above mentioned. These include the following:

(1) The construction of the transmission system can be significantly simplified, especially for those vehicles requiring large speed ratio range of multiple-speed steps or required to execute complicated operations.

(2) The layout of the vehicle can be simplified because the engine is connected to the wheel motor by hoses or pipes, without regard to their relative positions which is valuable in many vehicles, such as, minicar or ultra-minicar, self-propelled agricultural machines, military vehicles, construction machinery, etc.

(3) Easy realization of interchangeability and series design of the parts and components of the transmission system, so the requirements of different vehicles can be met by properly combining a series of components.

Since the hydrostatic transmission of wheel motor type has so many attractive advantages, it has often been the subject of designers and researchers. However, limited by the performance of its components (especially the wheel motors), the hydrostatic transmission of wheel motor type has, at present, only been used in some low speed or special purpose vehicles. Therefore, in order to adapt this technology effectively to middle or high speed vehicles, performance and construction of the wheel motors must be improved in order to satisfy the following requirements:

(1) It must be directly mounted in the wheels to drive the wheels without any additional speed reducing/increasing gearboxes.

(2) The hydromotor should have a rather wide speed range to satisfy the speed requirements of the vehicle. For example, for a car it must operate normally in the speed range of 0 to 1000 r.p.m. or above, and its efficiency must not decrease significantly with increased speed. The maximum speed of today's wheel motors is about 200–300 r.p.m., falling short of the above requirement, so its application is limited to low speed (less than 20–30 kilometer per hour) vehicles.

(3) The hydromotor should have high efficiency over a wide speed range. Most vehicles require high tractive forces during starting and climbing, which may be 20–30 times the relatively light load in normal operation. For instance, transportation trucks are running, for the most part, under light loads at medium to high speeds, just within the low efficiency region of today's hydraulic wheel motors. But fuel economy (overall efficiency) is often the major consideration in this kind of vehicle, which results in very strict demands on the efficiency performance of wheel motors. Specifically, it must have very high torque efficiency in starting as well as overall efficiency under light loads over a wide speed range. These requirements have not been met by the present hydromotors.

(4) The displacement of the hydraulic wheel motor should be variable to meet the requirement of further extending the speed range of the vehicle. Vehicle speed and load varies over a wide range in its operation and the maximum tractive effort required. Because of this, in a fixed displacement motor, the working pressure may fall to 10–30 kg/cm$^2$ during normal running, far from its high efficiency region. Moreover, at high vehicle speeds, the oil flow velocity in the hydraulic system increases proportionally with the vehicle speed resulting in a high flow loss, further reducing the overall efficiency of the system. If the displacement of the hydraulic motor is made variable, then its displacement can be decreased at above-mentioned working conditions to increase the working pressure and reduce the velocity of the oil flow to improve the overall efficiency of the system.

(5) It is necessary to simplify the construction and to lower the requirement on material and manufacturing technology so that hydrostatic transmissions may be more adaptable for mass production to cut down the cost and price. At present,the cost of hydrostatic transmissions is often much higher than mechanical transmissions, which is one of the main factors limiting its application.

(6) The hydraulic wheel motor must operate under the adverse conditions which may be encountered in its use, for instance, it should safely withstand the vibration and shock loads in operation, not be too sensitive to the working fluid and its filtration, easily repaired and maintained, etc.

To solve the problems mentioned above, attempts have been made to improve the construction of hydraulic wheel motors and vehicle hydraulic transmission systems. As an example, S.A.E. paper No. 790883 "An Interesting And Informative Comparison Of Mobile Hydrostatic Wheel Hub Drives" and S.A.E. 810971, 810974 have systematically described the present state of this art and emphatically compared the performance of the two popular types of hydraulic wheel motors today.

One type, the axial piston hydraulic motor with a planetary gearbox, is widely used in some vehicles, exploiting fully its capability of high speed, high pressure, high efficiency and continuously variable displacement. However, this type is characterized by complicated construction, the high price of the axial piston hydraulic motor and planetary gearbox, narrow speed range, low overall efficiency (including the efficiency of the planetary gearbox) and starting torque efficiency and its irregular external shape limits its use in many other applications.

The second type, the cam lobe hydromotor, has a relatively high starting torque efficiency and mechanical efficiency as well as a wider speed range than the axial piston type. However, it is also complicated in construction with its efficiency reduced significantly with increasing speed and is incapable of continuously variable displacement. Therefore its application is also limited to some low speed (less than 20 kilometer per hour) or special purpose vehicles.

As can be seen from the above, the application of hydrostatic transmissions of the wheel motor type is dependent, to a large extent, on the perfection of its performance. There must be a breakthrough in construction and performance of the wheel motor before hydrostatic transmissions of the wheel motor type may enjoy wide application. Moreover, a more perfect hydraulic transmission system with further improved overall efficiency and extended speed range must be developed to exploit fully the merits of the wheel motor.

OBJECTS OF THE INVENTION

Therefore, the primary object of this invention is to provide a new design for a hydraulic motor or pump characterized by high efficiency, wide speed range, simple construction and variable displacement. With this new design for a hydraulic motor or pump, a high efficiency and widely adjustable speed range hydrostatic transmission system is developed in which the hydraulic motor is employed to expand its applications. This hydrostatic transmission system can replace not only many current types of vehicle transmission systems but also finds use in many other machines.

A further object of the invention is to provide a hydraulic motor or pump having higher starting torque efficiency and mechanical efficiency by rationalizing the layout of the hydraulic motor and optimizing the hydraulic components.

Another object of the invention is to provide means by which the oil churning losses and oil flow losses in the motor or pump can be reduced in order to obtain a hydraulic motor or pump with a higher efficiency working region and wide speed range.

Another object of the invention is to provide a hydraulic motor or pump with higher rated maximum working speed by reducing the PV rating of its major sliding working surfaces and improved balancing of its rotating parts.

Another object of the invention is to provide a continuously variable displacement hydraulic motor or pump to further expand its application in hydrostatic transmission.

Another object of the invention is to provide means by which the displacement of the hydraulic motor or pump can be controlled continuously.

Another object of the invention is to provide a hydraulic motor with a small size, light weight and symmetrical shape which can be conveniently mounted in a wheel without the need for gearboxes.

Another object of the invention is to provide a hydraulic motor or pump which has a minimum number of parts and is simple in construction.

Another object of the invention is to provide a hydraulic motor which can sustain radial and axial shock from the wheel of the vehicle on rugged or rough roads.

Another object of the invention is to provide means for the mounting of a hydraulic motor or pump for improving layout and mounting of the wheel motor, pump, pipe lines and displacement control mechanism on a vehicle.

Another object of the invention is to provide a hydraulic transmission system for a vehicle in which the working mode of the wheel motor can be controlled separately to further extend the speed range of the vehicle.

Another object of the invention is to provide a vehicle hydraulic transmission system to accommodate the complicated situations it may encounter in use.

SUMMARY OF THE INVENTION

According to the present invention, an all-sided design of the hydraulic motor or pump and the hydrostatic transmission system has been improved to attain the objects mentioned above.

This invention provides a hydraulic motor or pump with a rotating casing and fixed shaft for simplifying the mounting of the wheel motor in a wheel of a vehicle and the flow distribution in the wheel motor.

In one embodiment of the present invention the hydraulic motor or pump comprises a casing with a number of planar surfaces, a cover, a plurality of bearings installed in said casing and said cover to support an eccentric shaft with an eccentric. A cylinder block is also provided with a number of radial cylinders having their center lines perpendicular to the axis of the eccentric shaft mounted on the outer periphery of said eccentric of said eccentric shaft. A piston in each of said cylinders has its outer flat end maintaining constant contact with said planar surface on said casing under the action of its centrifugal force, a return spring and the oil working pressure.

There are two separated groups of oil ducts in said eccentric shaft, one for oil inlet and the other for outlet. The eccentric of the eccentric shaft of the hydraulic motor or pump of the invention may be a combined eccentric which is composed of an eccentric shaft and an eccentric sleeve with a cylindrical inner bore and a cylindrical outer surface with an offset being rotatably mounted on said eccentric of said eccentric shaft through its bore and with said cylinder block mounted on the outer periphery thereof. The combined eccentric and consequently the piston stroke and displacement may be changed continuously when said eccentric sleeve is rotated on the said eccentric shaft to different positions by an external displacement control means.

A pin is inserted in a hole in the end face of said eccentric sleeve with its rectangular head engaged in the slot on the flange of the displacement control sleeve. The displacement control sleeve is fitted in the bearing inner ring and mounted on said eccentric shaft journal. A displacement control arm mounted on the eccentric shaft journal meshes with the end of said displacement control sleeve as dog tooth clutch or its internal teeth may engage the external teeth at the end of the displacement control sleeve. Said displacement control arm may be actuated by a displacement control device. Said displacement control arm may be actuated by a displacement control cylinder or other control means to rotate on said eccentric shaft and this motion will be transmitted through said displacement control sleeve and pin to said eccentric sleeve to rotate on said eccentric shaft to change said combined eccentric or the displacement of said hydraulic motor or pump. There are two separate oil grooves in said eccentric sleeve in communication with said oil ducts in the eccentric shaft respectively.

A number of safety pins pressed into said casing or said cover, each maintaining an appropriate clearance with its adjacent cylinder block wall to allow said cylinder to swing freely relative to said casing under normal operation and even at maximum displacement, but when there is a sudden change in rotating speed between said casing and said cylinder block, such as the braking of the casing, said safety pin will be in contact with said cylinder wheel block wall to limit the amplitude of said relative rotating movement and force said cylinder block to rotate at same speed with said casing to prevent said piston from moving off its seat. A circular oil cushion recess in the form of reticular grooves is machined in the piston end and filled with oil through a throttle hole to form a hydrostatic support.

Based on this variable displacement hydraulic motor or pump, a fixed displacement hydraulic motor or pump can be evolved by replacing said eccentric sleeve and said eccentric shaft with a single eccentric shaft with a fixed eccentric and eliminating said displacement control parts including pin, displacement control sleeve and said displacement control arm.

A spoon-shaped oil duct or ducts can be arranged in said displacement control sleeve or said thrust washer with its inner end communicating with said leakage oil passage in said eccentric shaft and its outer end extending deep down in said casing to scoop and discharge the leakage oil by its inertia and dynamic pressure during operation in order to reduce the oil churning loss at high speeds.

For the purpose of adjusting the displacement of said hydraulic motor or pump from outside of the motor, the double-acting piston of the displacement control cylinder actuates the displacement control arm controlled by a control valve which may be manual, automatic or a combination thereof. In the case of the automatic valve, the automatic control is based on one or several operating parameters, such as the engine torque, r.p.m. intake manifold vacuum, the contents of exhaust gas, the position of accelerator pedal or the oil flow rate or pressure etc. when the hydraulic motor or pump is used in a vehicle hydraulic transmission system.

This invention further provides a vehicle hydrostatic transmission system of wheel motor type, which comprises an engine or engines, an oil pump or pumps driven by said engine, oil pipe lines including high pressure line and low pressure line, an oil tank, and a wheel motor or motors receiving oil output from said oil pump and driven thereby, wherein the wheel motor or motors can either be the variable displacement or fixed displacement hydraulic motor or motors of this invention.

The hydrostatic transmission system of this invention may be further provided with a distribution valve or valves for controlling the working mode (drive or free-wheeling) of the wheel motors to get different modes of drive system combinations from one wheel driving to all wheels driving. The speed range of the vehicle can be further extended.

The hydrostatic transmission system of this invention may be further provided with a free-wheeling valve which is arranged between the high pressure line and low pressure line to bypass the oil pumped out from said wheel motor when the vehicle is in free-wheeling whereby the engine may run at an idle speed while the wheel motor is free wheeling. The free-wheeling valve may be controllable with a discharge valve to get engine brake effect or when starting the engine by towing the vehicle.

The hydrostatic transmission system of this invention may be further provided with a safety valve which is arranged between the high pressure line and the low pressure line to discharge the oil from the high pressure line to the low pressure line, the opening pressure of the safety valve being manually adjustable so at to work as a clutch.

The hydrostatic transmission system of this invention may be further provided with a gear box with a fixed ratio arranged between the engine and the oil pump.

This invention further provides a mounting bracket for facilitating the mounting of the wheel motor. The mounting bracket may be mounted directly to a frame or suspension system of a vehicle. The mounting bracket has a tapered hole in which the tapered section of the outer end of the eccentric shaft of the wheel motor is inserted and has three oil ducts with one end of each communicating respectively with the oil inlet, outlet and leakage oil passage in the eccentric shaft and with the other ends connected with the oil pipe lines.

BRIEF DESCRIPTION OF THE DRAWINGS

The above and other objects, features and advantages of this invention will be apparent in the following detailed description of illustrative embodiments, especially when taken in conjunction with the accompanying drawings, wherein.

DETAILED DESCRIPTION OF PREFERRED EMBODIMENTS

In order to promote a full understanding of the concepts and other aspects of the present invention, it is described by examples with reference to the accompanying figures.

The hydraulic motor or pump in accordance with one embodiment of the present invention is a continuously variable displacement or a fixed displacement radial piston type with a fixed shaft and rotating casing. Because the shaft is held stationary, the oil distributing function can be accomplished by the shaft and the cylinder block without the need for conventional distributing components and the wheel can be mounted directly to the rotating casing without conventional hubs and driving parts.

As a result of its unconventional working principle and construction, the hydraulic motor or pump of this invention is simple and compact with high efficiency and wide speed range.

Figure 1:
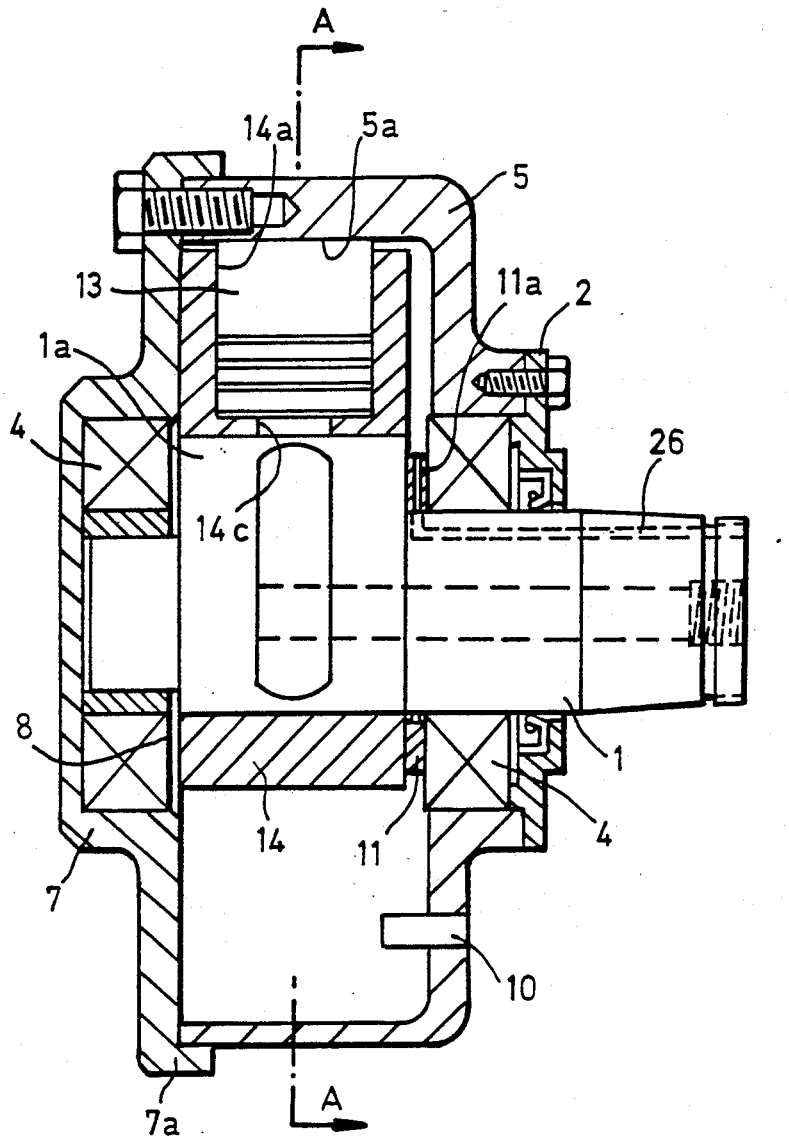
FIG. 1 is an axial cross-section of a fixed displacement motor or pump of the invention.
Figure 2:
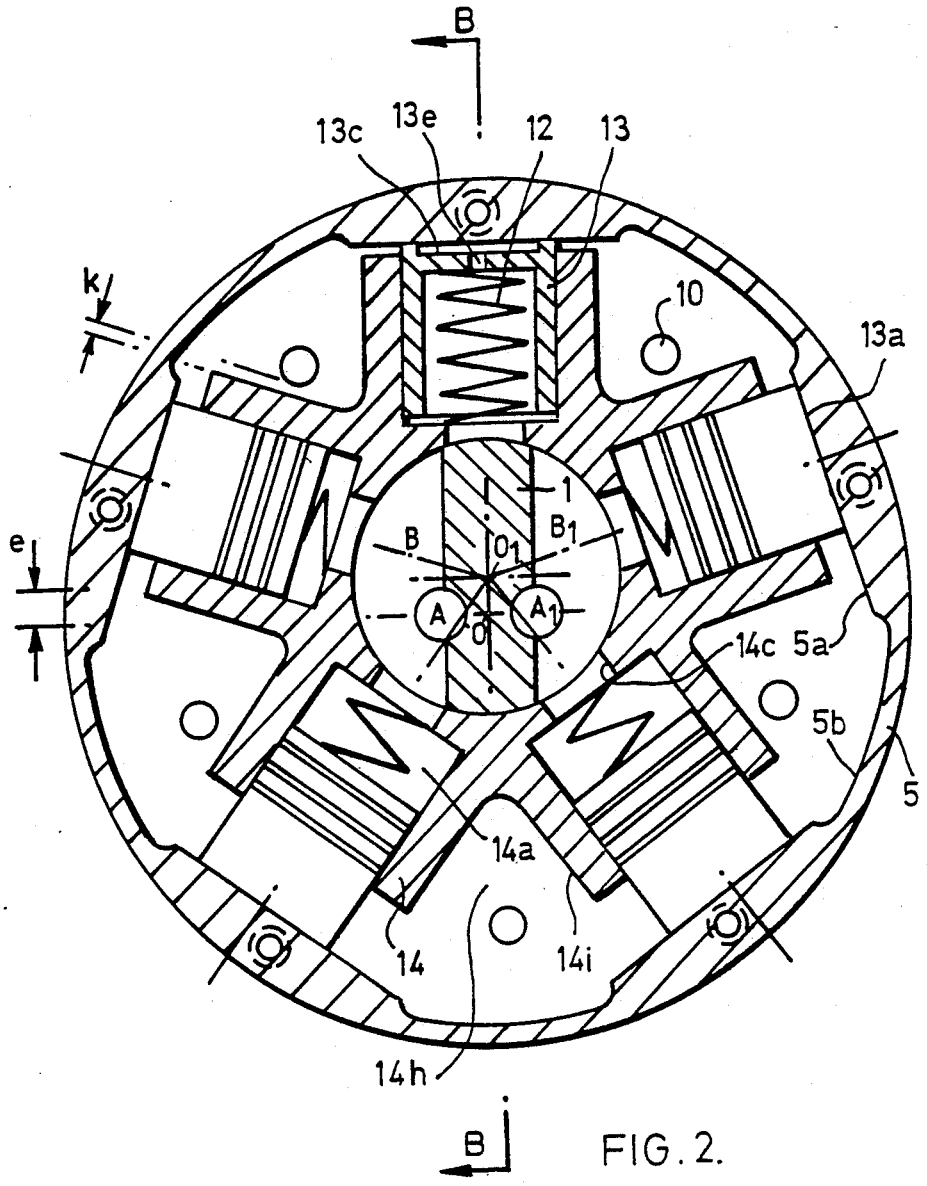
FIG. 2 is a cross section taken along line A—A in FIG. 1.

Referring now to FIGS. 1 and 2, there is shown a fixed displacement hydraulic motor or pump in accordance with one embodiment of the invention. It consists of an integral casing (5) with a number of planar surfaces (5*a*) on its inside wall, against which the outer ends of the pistons (13) maintain constant contact. The integral construction of the casing (5) reduces its deformation under loads and reinforcing ribs may be added on its outside for greater rigidity, if necessary.

Cover (7) with a reinforcing flange (7*a*) having a close fit with the casing (5) will help to reduce the deformation of the casing under the piston force and oil pressure and improves the contact between the pistons (13) and piston seats (5*a*). Bearings (4) are installed in casing (5) and cover (7) to support the eccentric shaft (1) with a fixed eccentric (1*a*) between the bearings (4). The capacity of the bearing (4) is determined by the permissible maximum oil pressure load and is much higher than the static and dynamic wheel loads insuring great safety in rugged or rough road operations under normal working pressure. Two separate oil passages (3), (9) are provided in the eccentric shaft for inlet and outlet communicating respectively with oil grooves (15) and (16) on the eccentric (1*a*). A star-shaped cylinder block (14) is rotatably mounted on the eccentric (1*a*) and has a number of radial cylinders (14*a*) machined with their center lines perpendicular to the axis of the eccentric shaft (1). The cylinder communicates in turn with oil grooves (15) and (16) through its oil port (14*c*). A piston (13) is installed in each cylinder (14*a*) with its outer flat end (13*a*) maintaining constant contact with the planar surface (5*a*) in casing (5). When the casing (5) performs a rotary motion relative to the eccentric shaft (1), the eccentric (1*a*) will impart a gyrating motion to the cylinder block causing each piston (13) to reciprocate in its cylinder (14*a*). This movement, coupled with the oil grooves (15) and (16) on the eccentric (1*a*), creates in each cylinder an intake and exhaust process of the oil necessary for the function of a hydraulic motor or pump. A pre-loaded return spring (12) is usually (may be omitted in some cases) installed between the piston (13) and the cylinder (14*a*) to force piston (13) outwards and maintains constant contact with the planar surface (5*a*) of the casing (5) in conjunction with oil pressure and centrifugal force in operation.

To reduce the friction and wear between piston (13) and the planar surface (5*a*) of the casing (5), a circular oil cushion recess (13*c*) in the form of reticular grooves is machined in the piston end (13*a*) and filled with oil through a throttle hole (13*e*), so that most of the metal to metal piston thrust force will be replaced by the oil pressure. Thrust washers (8) and (11) are located on both sides of the cylinder block (14) to limit its axial movement.

There are several safety pins (10) installed on the side wall of the casing (5) or cover (7) each maintaining an appropriate clearance with its adjacent cylinder wall (14I) to allow some free movement between cylinder block (14) and casing (5) under normal running conditions. However, when there is a sudden change in rotating speed between the casing (5) and the cylinder block (14), such as during the braking of the casing, the safety pin (10) will be in contact with the cylinder block (14) to force it to rotate at same speed with the casing to prevent piston (13) from moving off its piston seat (5*a*) to guarantee normal operation of the hydraulic pump or motor.

The cover (7) or casing (5) may be designed with wheel studs for the direct mounting of wheels. If required, a disc or drum brake may be incorporated in the seal cover (2) to satisfy the requirement of wheel motors with brakes.

The number of pistons (13) and corresponding planar surface (5*a*) can be any arbitrary integer, preferably 3, 5 or 7 for the uniformity of the oil flow and convenience of manufacture. Multi-cylinder banks may also be used to increase the power rating. The tapered section of the outer end of the eccentric shaft (1) is mounted in a mounting bracket so that wheel or pump can be mounted at any desired position on the vehicle.

When high pressure oil is fed through oil passage (3) and groove (15) in eccentric shaft (1) into the motor, the pistons (13) in the cylinders (14*a*) communicating with groove (15) will be forced out by oil pressure against the planar surface (5*a*) of the casing (5). Because the resultant of the piston forces acting on the surface passes through the center $O_1$ of the eccentric (1*a*) and there is an offset between center $O_1$ and the center O of the casing (5), a torque will be produced to rotate the casing (5) about its center O as a motor. When the cylinder further moves offset line $OO_1$ in a counterclockwise direction, it will be in communication with the outlet groove (16) and passage (9).

Pistons (13 will be pushed inward by relative movement of planar surface (5*a*) and discharge oil through the low pressure outlets. Conversely, if passage (9) and groove (16) are connected to the high pressure inlet and passage (3) and groove (15) to the low pressure outlet, the motor will turn in the opposite direction. Similarly, if the casing (5) is driven by a power source, it will work as a pump.

It should be emphasized that the turning moment of the motor or pump above is produced by the offset of the casing (5) to the cylinder block (14). The piston (13) is free from the overturning moment and lateral force, so the mechanical friction losses are minimized and the piston height can be reduced to make the motor more compact. This is contrasted with today's low speed, high torque wheel motors wherein the turning moment is transmitted by an overturning moment on the piston resulting in significantly reducing mechanical efficiency, especially at starting due to the large lateral forces acting between the piston and the cylinder wall.

The main mechanical losses of the hydraulic motor or pump above stated at high speed comprise oil flow losses in oil passages and oil churning loss produced by the relative movement between the cylinder block (14) and the casing (5) during the operation, so these losses often become the main factors limiting the permissible maximum speed of the motor or pump and will be increased with the operating speed parabolically. To extend the speed range, a spoon-shaped oil duct (11*a*) is arranged in the thrust washer (11) with its inner end communicating with the leakage oil passage (26) in the eccentric shaft (1) and its outer end extending down into the casing to scoop and discharge the leakage oil from the casing. It is then carried through the leakage oil passage (26) to an outside reservoir by the dynamic pressure and the inertia of the leakage oil in operation to scavenge the oil leakage accumulated in the casing (5) to reduce the oil churning losses at high speed operation.

Figure 3:
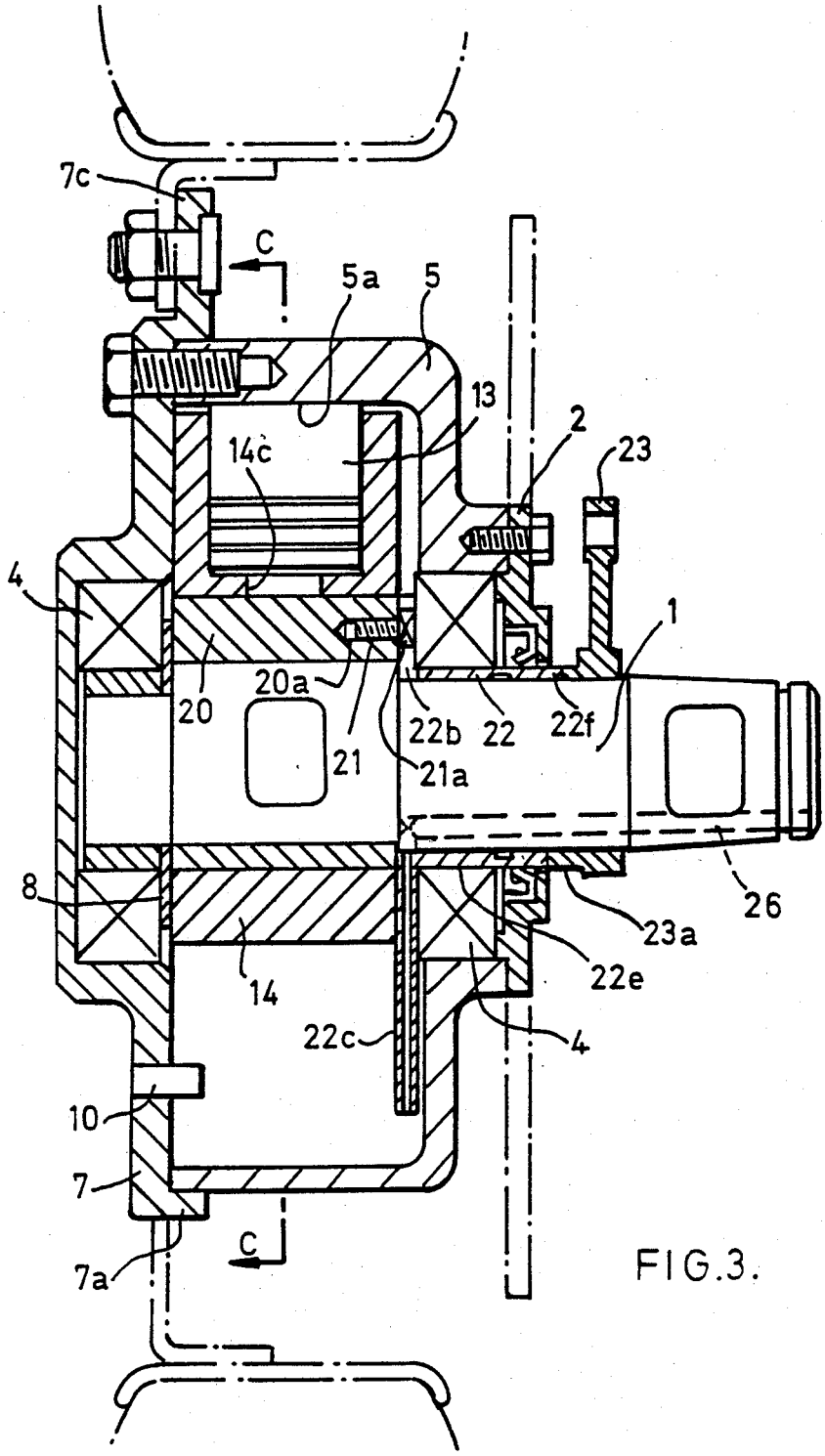
FIG. 3 is an axial cross section of a continuously variable displacement motor or pump in accordance with one embodiment of the present invention.
Figure 4:
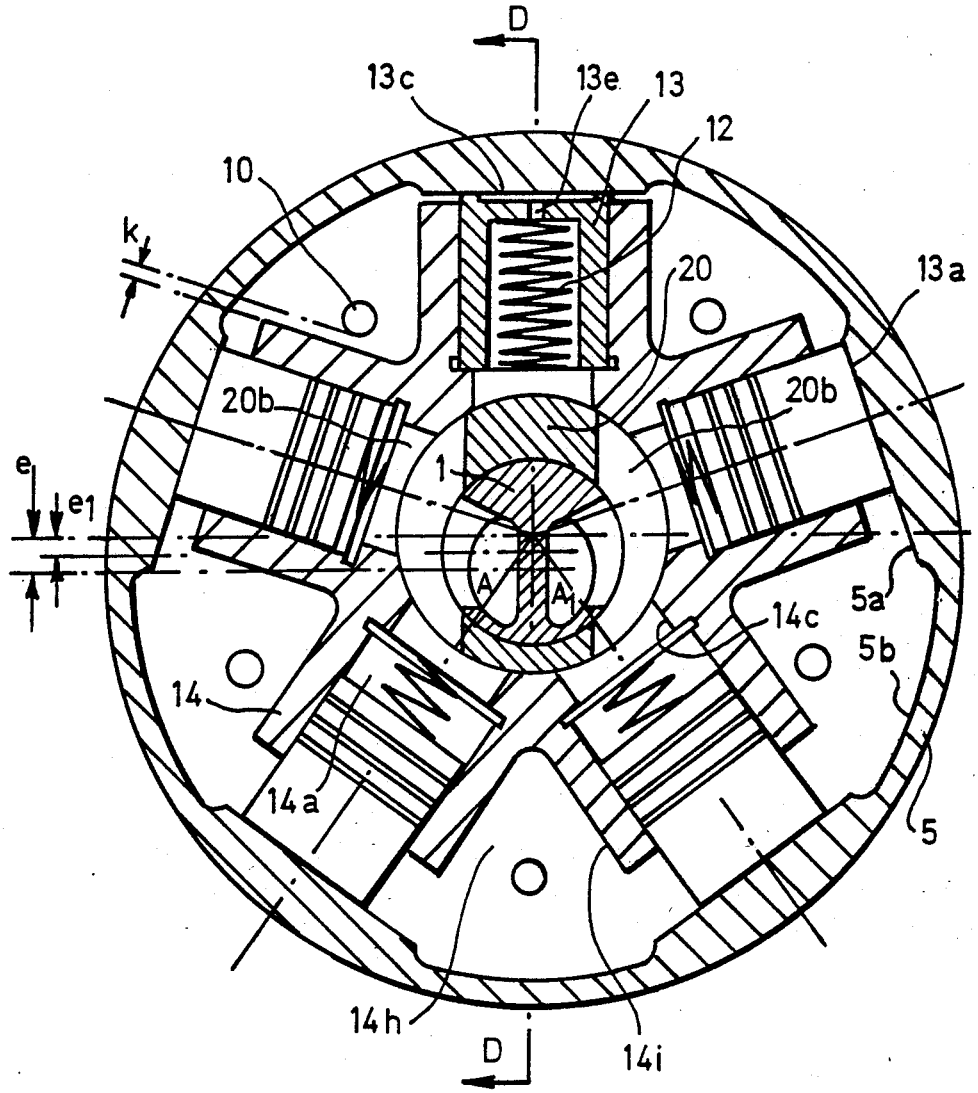
FIG. 4 is a cross section taken along line C—C in FIG. 3.

FIGS. 3 and 4 are illustrations of a variable displacement hydraulic motor or pump in accordance with another embodiment of the present invention. It differs from the fixed displacement hydraulic motor in that the eccentric shaft (1) as shown in FIGS. 1 and 2 is now replaced by an eccentric shaft (1) and an eccentric sleeve (20) to form a combined eccentric. The eccentric sleeve (20) is rotatably mounted on the eccentric shaft (1) with its inner bore, the outer periphery of the eccentric sleeve (20), parallel to the inner bore and having a offset there between. The combined eccentric and consequently the piston stroke and displacement may be continuously changed when the eccentric sleeve (20) is rotated on the eccentric shaft (1) to different positions. This requires the provision of a controlling means available to continuously control the angular position of the eccentric sleeve (20) relative to the eccentric (1*a*).

Such a controlling means is proposed by the invention. This controlling means is characterized by a pinhole (20*a*) machined in the end face (20*f*) of the eccentric sleeve (20). A sliding-fit pin head (21) is inserted into the pin hole (20*a*) with its rectangular head (21*a*) engaged in the slot (22*b*) on the flange of a displacement control sleeve (22) which is fit tightly against the inner race of bearing (4) and slidably fit (or fit with needle bearing) on the eccentric shaft (1). A displacement control arm (23) mounted on the eccentric shaft (1) meshes the end of the displacement sleeve (22) as a dog tooth clutch (22*f*) or its internal teeth may engage the external teeth at the end of the displacement control sleeve (22).

When the displacement control arm (23) is actuated by a displacement control mechanism to apply a torque in either direction to the displacement control sleeve (22) to rotate it on the eccentric shaft (1), this motion will be transmitted to the eccentric sleeve (20) through pin (21) to change the combined eccentric. The eccentric sleeve (20) has two separate oil grooves (25) and (29) in communication with the oil passages (27) and (28) of eccentric shaft (1). All other parts are the same with the fixed displacement motor or pump above mentioned and illustrated in FIGS. 1 and 2 to facilitate manufacturing.

The number of cylinders can be any arbitrary integers, preferably 3, 5 or 7. Multi-cylinder banks may also be used to increase the power rating.

As tests have shown, the variable displacement hydraulic motor or pump of the invention can satisfy the vehicle drive requirements. For example, the motor speed ranges from zero to 1500 r.p.m. equivalent to vehicle speeds from zero to 150 kilometer per hour when the wheel is directly driven by the wheel motor. There is a wide high efficiency region with a maximum mechanical efficiency of 0.97 and a slightly lower starting efficiency, so the vehicle can enjoy an overall high efficiency under most working conditions. Employment of the variable displacement pump or motor will result in an ideal stepless transmission system with wide adjustable speed ratio and high working efficiency. The wheel motor can sustain safely the dynamic wheel loads under severe running conditions with its large capacity bearings and strong casing and cover construction. It is not sensitive to the temperature, vibration, shock, oil and its filtration, etc. Its manufacturing cost is significantly low as its main components are simple in construction and easy for production.

Figure 8:
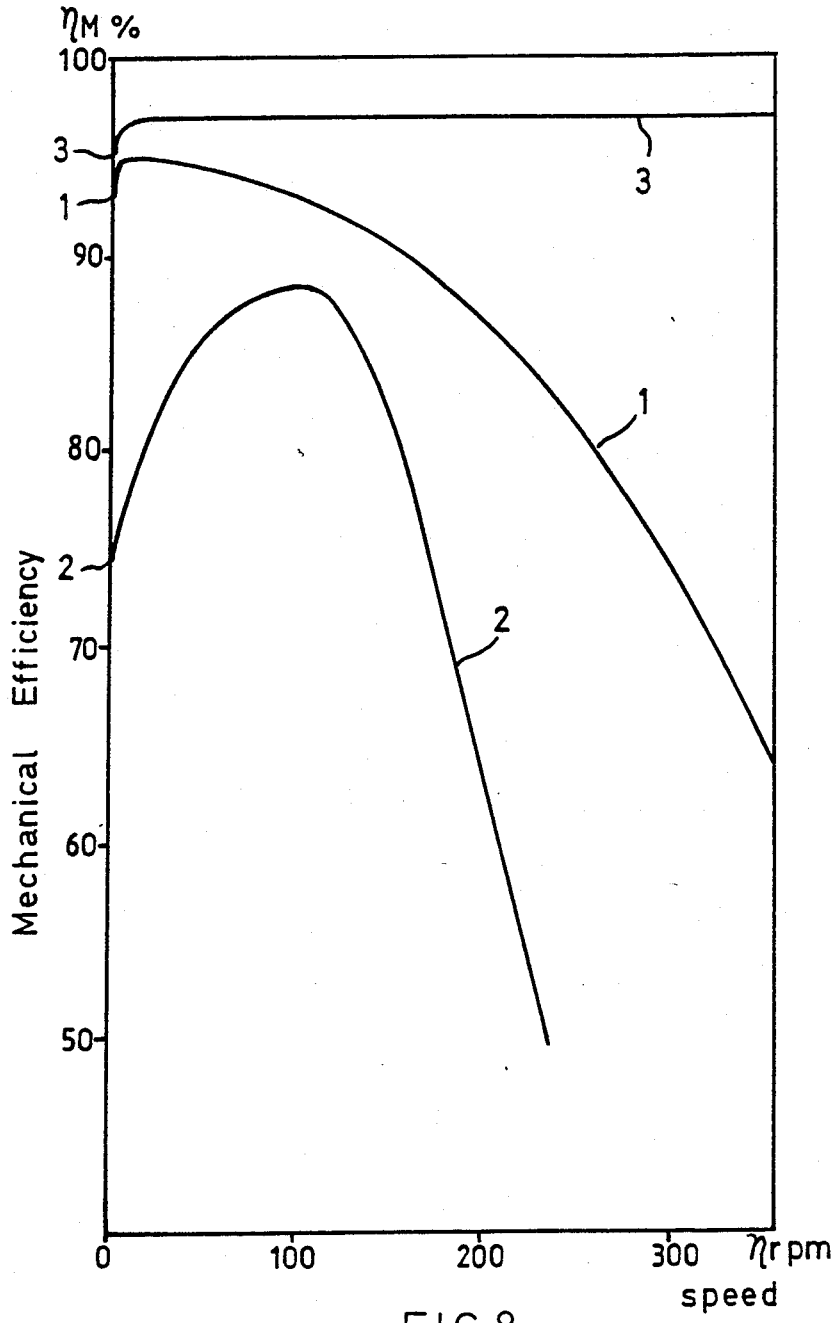
FIG. 8 shows a comparison of mechanical efficiency of the hydraulic motor of the present invention with those of a axial piston motor with planetary gearbox and a cam lobe hydromotor.

FIG. 8 is a comparison of starting torque efficiency and mechanical efficiency of hydraulic motors of the invention with those of axial piston motor with planetary gearbox (curve 2) and cam lobe motors (curve 1) in SAE paper 790883. It is obvious that efficiencies of motors of this invention are the highest within a remarkably wider speed range.

The hydraulic motor or pump of the invention has many advantages and the superiority of the wheel motor type hydrostatic transmission can be fully exploited in vehicle drive applications, so that its application can be widened remarkably. For example, in agricultural and construction machines, transportation and towing machines, minicars, all terrain vehicles and machine transmission systems etc., it will benefit them with simplicity in construction, convenience in layout, reduction in cost, stepless speed change and automatic control.

The method of mounting the wheel motor on the vehicle has great influence on its reliability. Further, the mounting method will effect the layout of oil pipe lines of the hydrostatic transmission system as well as its related components. Normally, wheel motors with a rotating casing are mounted directly on the vehicle in the cantilever form (through the suspension torque-thrust member or mounted directly to the vehicle frame) resulting in the mounted part of the motor being heavily stressed by dynamic and impact loads acting on the wheel. Loosening or even breakage will often occur if no proper measure is taken. Since the center distance between the oil inlet and outlet passages in the eccentric shaft is very limited by the journal diameter, the oil pipe connected directly to the end of the shaft will be too small in size and difficult in layout and installation. Under certain conditions, tremendous rigidity will be required at the point where displacement control and/or braking actuation mechanism are connected to the wheel motor. The invention solves these problems by mounting the wheel motor to a mounting bracket.

Figure 5:
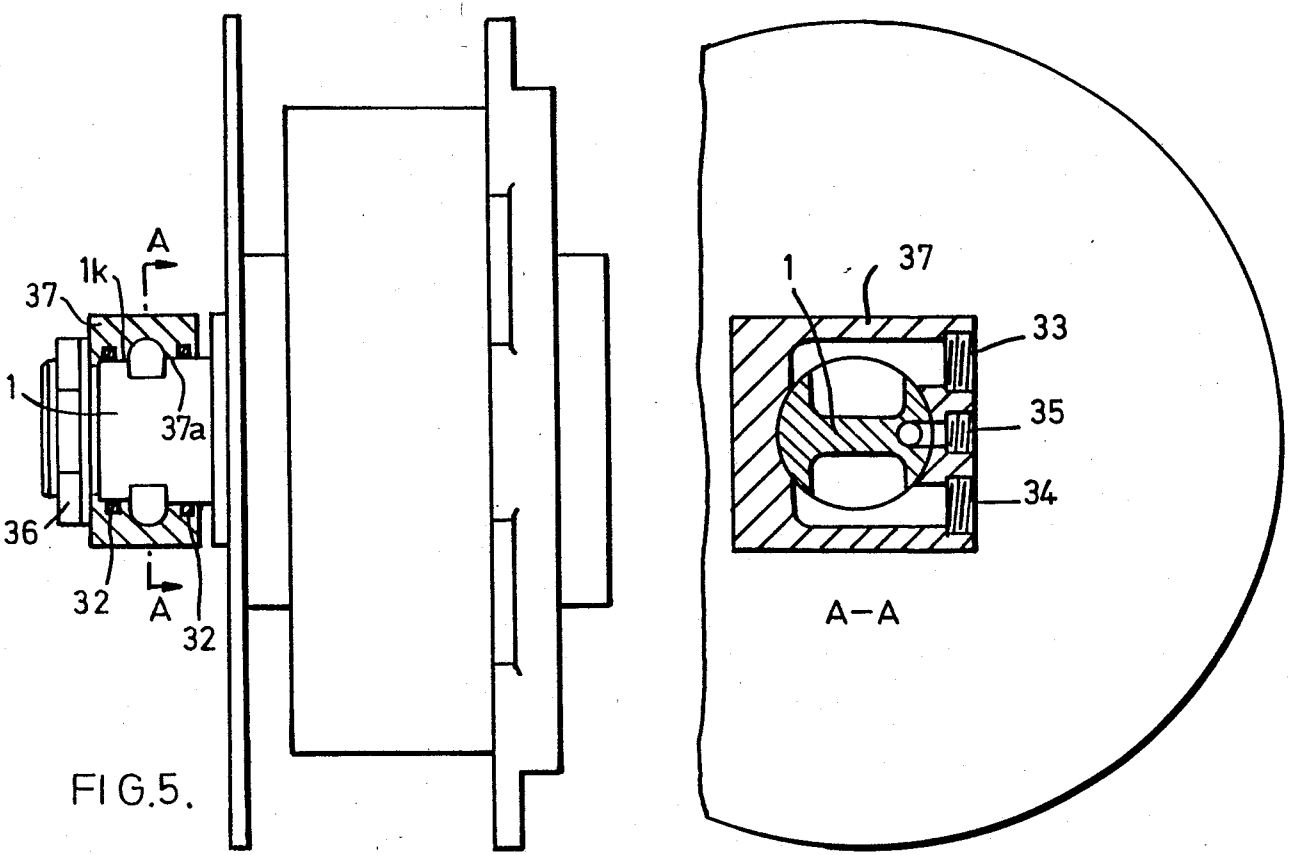
FIG. 5 shows the mounting of a wheel motor in accordance with one embodiment of the present invention.

FIG. 5 illustrates a wheel motor mounted in a wheel. The outer end of the eccentric shaft (1) with a tapered section (1*k*) is inserted into the tapered bore (37*a*) of the mounting bracket (37) and held in position securely by nut (36) with two O-rings (32) to prevent leakage. There are three pipe thread holes for pipe fittings (33, 34, 35) in the mounting bracket (37) to communicate with the inlet, outlet and oil leakage passages in the eccentric shaft respectively. The position of the thread holes (33, 34, 35) can be arranged for convenient layout of the oil pipes (in some cases, oil pipe may be installed direct to the oil passages at the end of the shaft). Flange or bolt holes may be provided on the mounting bracket for the mounting of brake or displacement control mechanisms. The mounting bracket (37) is in turn mounted directly to the suspension system or frame of the vehicle.

Figure 6:
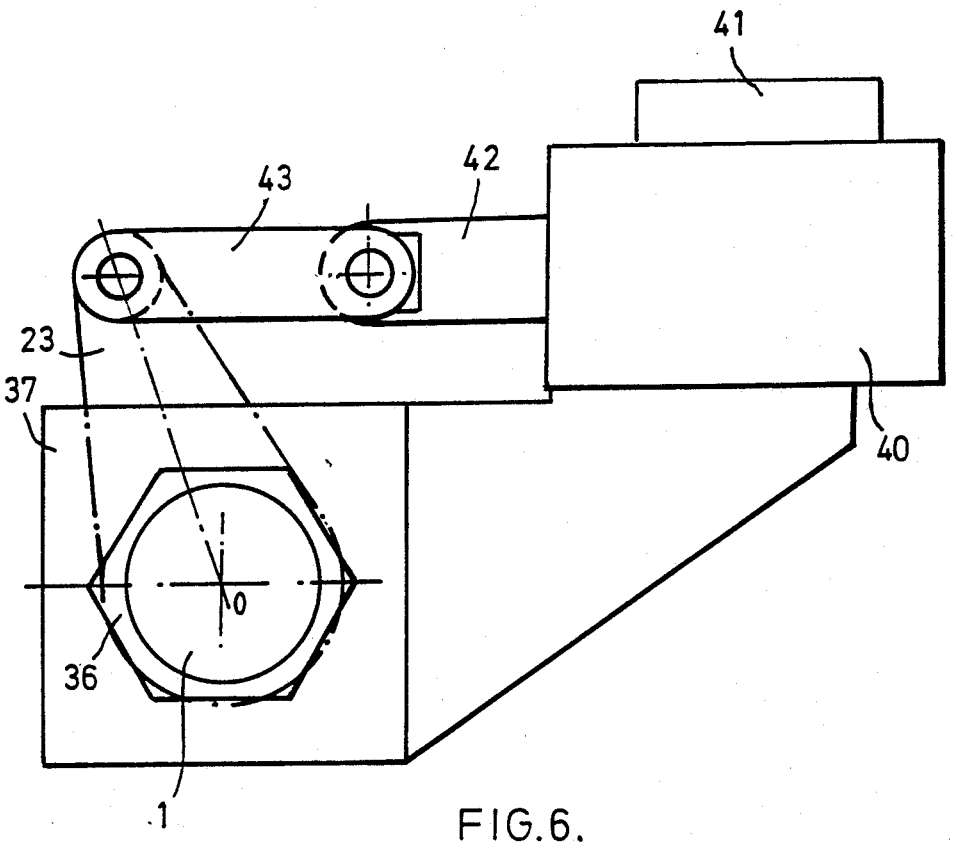
FIG. 6 is a side view of a variable displacement control mechanism of a wheel motor in accordance with one embodiment of the present invention.

FIG. 6 illustrates a displacement control mechanism for the variable displacement motor or pump. A displacement control cylinder (40) with a double-acting piston (42) controlled by control valve (41) is installed on the mounting bracket (37). The piston (42) reciprocates in cylinder (40) to push or pull the displacement control arm (23) to rotate by means of connecting rod (43) around the eccentric shaft (1). This movement will be transmitted through displacement control sleeve (22) and pin (21) to rotate eccentric sleeve (20) on the eccentric (1*a*) and to continuously change the combined eccentric or displacement of the motor or pump as required. The control valve (41) may be manually or automatically operated. In automatic control, control valve (41) may be controlled by one or more operating parameters, such as, the r.p.m., torque, intake manifold vacuum, contents of exhaust gas, position of accelerator pedal of the engine, the oil flow rate and pressure in the hydraulic system, etc. To accommodate the complicated situations which may be encountered in use, the control valve (41) may be operated by the operator as well as the automatic system.

Figure 7:
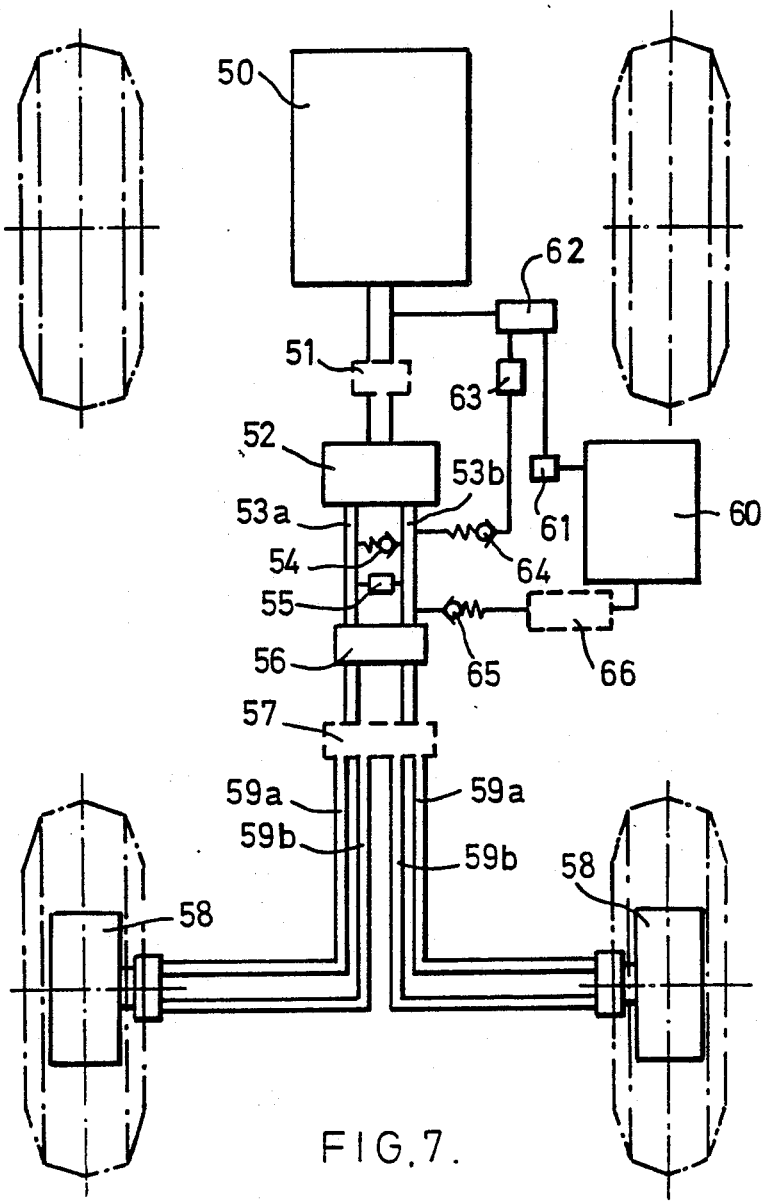
FIG. 7 is a plan view of a hydrostatic transmission system of wheel motor type in accordance with one embodiment of the present invention for a 4×2 drive vehicle.

A closed hydraulic circuit is usually employed in the vehicle hydrostatic transmission system to reduce the weight and size of the oil tank. As an example, FIG. 7 shows a hydraulic transmission system in a 4×2 vehicle wheel motor. This hydraulic transmission system can be used in all kinds of drive-systems, such as 3×1, 3×2, 3×3, 4×1, 4×2, 4×4, 6×2, 6×4, 6×6, 8×2, 8×4, 8×6, 8×8, etc.

Engine (50), which may be a gasoline or diesel engine or the like may be placed in any part of a vehicle according to its layout requirements. The output shaft of the engine (50) drives the pump (52) directly or through a fixed ratio gearbox (51) whose ratio is determinated by the rated maximum speeds of the engine and the pump. The pump can be selected from radial piston pumps according to the invention, axial piston type or other high efficiency types and with fixed displacement or variable displacement (either, uni- or bi-directional). As an example, a uni-directional variable displacement pump in the hydraulic system is shown in FIG. 7. Obviously, it is not difficult to deduce a hydraulic system with the bi-directional variable displacement pump according to the same principle. The high pressure oil from pump (52) flows through high pressure oil pipe (53*a*) to direction valve (56) (not required when the bi-directional pump is used) which controls the running direction of the wheel motor, namely, forward or reverse. The direction valve (56) is similar to a four-port three-position valve in construction. When in its neutral (middle) position, the high pressure oil pipe (53*a*) is communicated with the return (low pressure) oil pipe (53*b*) thus, the direction valve (56) works as a disengaged clutch or neutral gear. The motors will run in the forward or reverse when it is in the two other positions.

The high pressure oil flows directly from direction valve (56) to wheel motors (58) or via distributing valve (57) to control the working mode (driving or free-wheeling) of the right and left hand wheel motor. When in the free-wheeling mode, the motor inlet oil pipe (59*a*) communicates its outlet oil pipe (59*b*) with oil circulating freely through the free-wheeling motor. Because all the valves or wheel motors can be controlled independently so the distributing valve (57) may also create three operating modes in the hydraulic system for the vehicle, namely, right wheel driving only, left wheel driving only and both wheels driving. The one wheel driving mode will further extend the speed range. Because all the valves or wheel motors can be controlled independently so the distributing valve (57) has another function equivalent to a different lock when the wheels are slipping on the ground. The distributing valve in conjunction with the appropriate control system, can also be used in multi-axle or multi-wheel drive systems with the number of the valves in the distributing valve corresponding to the number of wheel motors in the system allowing all kinds of driving modes ranging from one wheel driving to all wheels driving with different combinations.

The distributing valve (57) can also be designed as an automatic distributing valve (proportional valve) to control the flow to the motors according to displacement of the wheel motors automatically, so that it will limit the oil flow to the wheels slipping on the ground due to low adhesion or load transfer while maintaining the tractive efforts of other driving wheels.

In the closed circuit hydraulic system, the oil from the wheel motor returns to the direction valve (56) via motor oil outlet pipe (59*b*) (and distributing valve) and then through return oil pipe (53*b*) to the intake port of pump (52), forming a closed circuit.

Certain additional oil circuits may be incorporated in the hydraulic system to cope with more complicated vehicle operating conditions:

(1) Free-wheeling circuit. When the accelerator pedal of the vehicle is suddenly released during the running, the speed of the engine will decrease faster than vehicle deceleration due to the greater inertia of the vehicle. Under such circumstances, the wheel motor will turn to work as a pump and the pump as a motor driving the engine, resulting in an engine braking effect on the vehicle. This problem may be solved by shifting the direction valve (56) into neutral, but it is not convenient for the driver. A free-wheeling valve (54) which is a one-way valve may be arranged between the high pressure oil pipe (53*a*) and return oil pipe (53*b*). When the vehicle is coasting, the oil pressure in pipe (53*b*) will be higher than that in pipe (53*a*) and the valve (54) will be forced to open to bypass most of the oil from the motor (58) thereby eliminating the engine braking to allow the wheel motor free-wheeling while engine idling.

The free-wheeling valve (54) will remain closed in normal vehicle running. If necessary, free-wheeling valve (54) and discharge valve (65) can be manually locked for engine-braking or starting engine by towing the vehicle.

(2) Safety or overload protection circuit. When the working pressure in oil pipes (53*a*) or (53*b*) exceeds its permissible maximum, safety valve (55) will open and discharge the oil from the high pressure to the low pressure pipe to protect components in the system from damage. The working pressure difference of safety valve (55) may be manually adjustable so that it may be used by the operator as a clutch.

(3) Oil charge circuit. Usually, a close hydraulic circuit needs a oil charge circuit to replenish the oil lost due to leakage. As shown in FIG. 7, engine (50) drives an oil charge pump (62) which draws oil from oil tank (60) via a coarse filter (61) and pumps it into the return oil pipe (53*b*) through a fine filter (63) and a one-way replenish oil valve (64) to the feed pump.

Any excess oil from the main hydraulic circuit will pass through the one-way discharge valve (65) and oil cooler (66) before being discharged into oil tank (60). Due to the high efficiency of the hydraulic motor and the optimization of the hydraulic transmission system of this invention, the oil cooler (66) can be omitted on certain transporting vehicles to further simplify the system.

A brake valve (not shown in the drawing) can be incorporated in the hydraulic system, to brake the vehicle by throttling the flow of return oil from the wheel motor and the brake effect can be adjusted by the brake valve.

Although particular illustrative embodiments of the present invention have been described herein with reference to the accompanying drawings, the present invention is not limited to these particular embodiments. Various changes and modifications may be made thereto by those skilled in the art without departing from the spirit or scope of the invention, which is defined by the appended claims.

What is claimed is:

1. A vehicle hydrostatic transmission system of a wheel motor type, which comprises an engine, an oil pump driven by said engine, oil pipe lines including a high pressure line and a low pressure line, an oil tank connected to the oil pump by a charge pump circuit, and at least one wheel motor receiving oil output from the oil pump and driven thereby, wherein the wheel motor is a variable displacement hydraulic motor with a rotating casing and fixed shaft having:

(a) a casing having a plurality of planar surfaces on the inner surface;

(b) a cover therefor;

(c) bearings fitted in the central part of said casing and cover;

(d) an eccentric shaft with an eccentric supported between said bearings, said eccentric shaft having two separated groups of fluid passages disposed therein and fluid distributing means communicating therewith for conducting a fluid, one group of said fluid passages being connected to a high pressure fluid system and the other group of fluid passages to a low pressure fluid system;

(e) a cylinder block rotatably mounted on the outer periphery of the eccentric of said eccentric shaft, said cylinder block having a plurality of cylinders corresponding to said plurality of the planar surface in said casing, radially arranged in a plane perpendicular to the axis of said eccentric and eccentric shaft;

(f) a sliding piston fitted in each said cylindres, each piston having an outer flat end contacting with a planar surface in said casing, whereby when said casing is provided with rotary movement relative to said eccentric shaft, said eccentric urges said pistons to reciprocatingly slide in said cylinders in turn; and wherein the eccentric of the eccentric shaft and eccentric sleeve with a bore and two separate arcuate fluid distributing grooves communicating respectively with said two separate groups of fluid passages in said eccentric shaft and with said cylinders in said cylinder block in turn to work as a distributing valve, said eccentric sleeve being rotatably mounted on said eccentric shaft through its bore and with said cylinder block mounted on the outer periphery thereof, the dimension of said combined eccentric being adjustable continuously by a controlling means to control the relative angular position of said eccentric sleeve to said eccentric shaft to adjust the displacement of said hydraulic motor or pump continuously.

2. A vehicle hydrostatic transmission system of wheel motor type as in claim 1, further comprising a free-wheeling valve which is a check valve arranged between said high pressure line and low pressure line to bypass the oil pumped out from said wheel motor when the vehicle is free-wheeling.

3. A vehicle hydrostatic transmission system of wheel motor type as in claim 1, further comprising a safety valve which is arranged between said high pressure line and said low pressure line to discharge the oil from the high pressure line to the low pressure line.

4. A vehicle hydrostatic transmission system of wheel motor type as in claim 1, further comprising a gearbox with a fixed ratio which is arranged between said engine and said oil pump.

5. A vehicle hydrostatic transmission system of wheel motor type as in claim 1 wherein said hydraulic wheel motor, is mounted in a wheel and the wheel motor is attached by a mounting bracket to a frame or suspension system of a vehicle, said mounting bracket having a tapered hole in which a tapered section of the outer end of the eccentric shaft of the wheel motor is inserted and having three oil ducts with ends communicating with an inlet, outlet and leakage oil passages in said eccentric shaft and with the other ends connected with said oil pipe lines.

6. A vehicle hydrostatic transmission system of a wheel motor type according to claim 1 wherein the eccentric sleeve of the variable displacement hydraulic motor further comprises a sliding pin hole in its end face, in which a sliding pin is fitted, the sliding pin extending to a sliding groove in a displacement control sleeve slidably and rotatably mounted on the eccentric shaft, the outside face of the displacement control sleeve having teeth to connect to an outside displacement control means, whereby a sufficient torque may be applied to the displacement control sleeve to rotate it relative to the eccentric shaft and transmitted via the slide groove and pin to the eccentric sleeve urging the eccentric sleeve to produce a relative rotary movement to the eccentric to adjust the dimension of the combined eccentric continuously, and further comprising a displacement control arm having teeth means to engage the teeth on the displacement control sleeve and coaxially mounted with a sliding fit on the eccentric shaft externally to the displacement control means comprising a displacement control cylinder with a double-acting piston arranged outside of the hydraulic motor and connected to the displacement control arm by a connecting rod, the action of the double-acting piston being controlled by a valve which is controllable manually, automatically or by a combination thereof.

* * * * *